US006698538B2

(12) United States Patent
Kristiansen et al.

(10) Patent No.: US 6,698,538 B2
(45) Date of Patent: Mar. 2, 2004

(54) DRILL BIT HAVING ADJUSTABLE TOTAL FLOW AREA

(75) Inventors: Steffen S. Kristiansen, Stavanger (NO); Michael G. Azar, The Woodlands, TX (US); John Zhang, Tomball, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/136,459

(22) Filed: May 1, 2002

(65) Prior Publication Data

US 2003/0010532 A1 Jan. 16, 2003

Related U.S. Application Data

(60) Provisional application No. 60/304,555, filed on Jul. 11, 2001.

(51) Int. Cl.[7] ..... E21B 10/60
(52) U.S. Cl. ..... 175/340; 175/393; 175/57
(58) Field of Search ..... 175/340, 57, 40, 175/393, 339, 317

(56) References Cited

U.S. PATENT DOCUMENTS 3,213,949 A 10/1965 Kistler, Jr. ..... 175/232
3,645,331 A 2/1972 Maurer et al. ..... 175/65
3,645,346 A 2/1972 Miller et al. ..... 175/237
4,106,575 A * 8/1978 Bunnelle ..... 175/170
5,934,389 A 8/1999 Ramsey et al. ..... 175/57

FOREIGN PATENT DOCUMENTS

JP 2000-120364 4/2000 ..... E21B/7/20

OTHER PUBLICATIONS

European Search Report dated Nov. 8, 2002, 4 pages.

* cited by examiner

*Primary Examiner*—David Bagnell
*Assistant Examiner*—Jennifer R Dougherty
(74) *Attorney, Agent, or Firm*—Rosenthal & Osha L.L.P.

(57) ABSTRACT

A drill bit is disclosed which includes a bit body having a plurality of ports therein arranged to provide a flow path between an interior of a drill string and the exterior of the bit body. At least one flow relief is disposed in one of the ports. The at least one flow relief is adapted to provide an increase in total flow area of the bit upon application to the bit of a selected fluid flow condition. A method for changing a total flow area of a drill bit is also disclosed, which includes pumping drilling fluid through the drill bit and operating a flow relief disposed in the bit to change the total flow area of the bit.

16 Claims, 4 Drawing Sheets

DRILL BIT HAVING ADJUSTABLE TOTAL FLOW AREA

CROSS-REFERENCE TO RELATED APPLICATIONS

This invention claims priority from U.S. Provisional Application Ser. No. 60/304,555, filed on Jul. 11, 2001.

BACKGROUND OF INVENTION

1. Field of the Invention

The invention is related to the field of drill bits used to drill wellbores through earth formations. More specifically, the invention is related to types of nozzles, jets and other devices which affect the hydraulic properties of a drill bit.

2. Background Art

Drill bits used to drill wellbores through earth formations include, for example, fixed cutter bits, such as polycrystalline diamond compact ("PDC") bits, and roller cone or "rock" bits. Generally, these drill bits include a bit body which can be coupled to a drill string to rotate the bit, and various forms of cutting elements attached to the bit. PDC bits include PDC cutters affixed to the bit body, while roller cone bits include at least one roller cone rotatably mounted to the bit body. The roller cone includes cutting elements thereon, such as milled steel teeth or various forms of inserts.

Most of these drill bits include at least one, and typically a plurality of, "nozzles" or "jets" which are hydraulically coupled to the interior of the bit body. During drilling operations, as the drill bit is rotated, a drilling fluid ("drilling mud") is pumped through the interior of the drill string, where it is discharged through the jets. The drilling mud then travels upward through the annular space between the drill string and the wellbore. The drilling fluid cools and lubricates the cutting elements and the bit body, and cleans cuttings from the bottom of the wellbore as it is drilled. The drilling fluid also lifts the cuttings from the wellbore and transports them to the earth's surface.

The number of, flow area (or orifice size) of, and placement of the jets on any particular drill bit depend on, among other factors, the hydraulic characteristics needed to drill a particular formation at a particular depth in a wellbore, and the type of bit being used. Typically, the wellbore operator desires to have a selected total flow area ("TFA") of all the jets on the bit so that the drilling fluid circulation system will provide a selected pressure drop in the drilling fluid at a selected drilling fluid flow rate.

In certain circumstances, it is desirable to change the TFA of a bit during drilling of a particular wellbore. These circumstances may include, for example, that as the depth of the wellbore increases, the fluid pressure loss due to friction increases. Flow rates of the drilling fluid typically must be increased in order to maintain the necessary flow through the jets on the bit. More recently, specialized directional drilling tools, known as "rotary steerable" systems have been developed for enabling wellbore operators to control the trajectory of the wellbore while rotating the drill string. When rotary steerable systems are used, an amount of pressure drop in the drill string may be limited by the pressure drop capacity of the rotary steerable system. In such cases, it is desirable to change the TFA of the drill bit to reduce fluid pressure drop along the entire drill string.

Changing TFA in a typical drill bit includes changing a flow area of one or more of the jets, or replacing a plug in a port therefore in the bit body with an orifice or jet.

However, changing the TFA of the bit requires removing the entire drill string from the wellbore to make the jet, plug or orifice change. Removing the drill string can be expensive and time consuming. It is desirable to have a drill bit which can have the TFA changed during drilling without removing the bit from the wellbore.

SUMMARY OF INVENTION

One aspect of the invention is a drill bit which includes a bit body having a plurality of ports therein arranged to provide a flow path between an interior of a drill string and the exterior of the bit body. At least one flow relief is disposed in one of the ports. The at least one flow relief is adapted to provide an increase in total flow area of the bit upon application to the bit of a selected fluid flow condition.

Another aspect of the invention is a method for changing a total flow area of a drill bit, which includes pumping drilling fluid through the drill bit and operating a flow relief disposed in the bit to change the total flow area of the bit.

DETAILED DESCRIPTION

Figure 1:
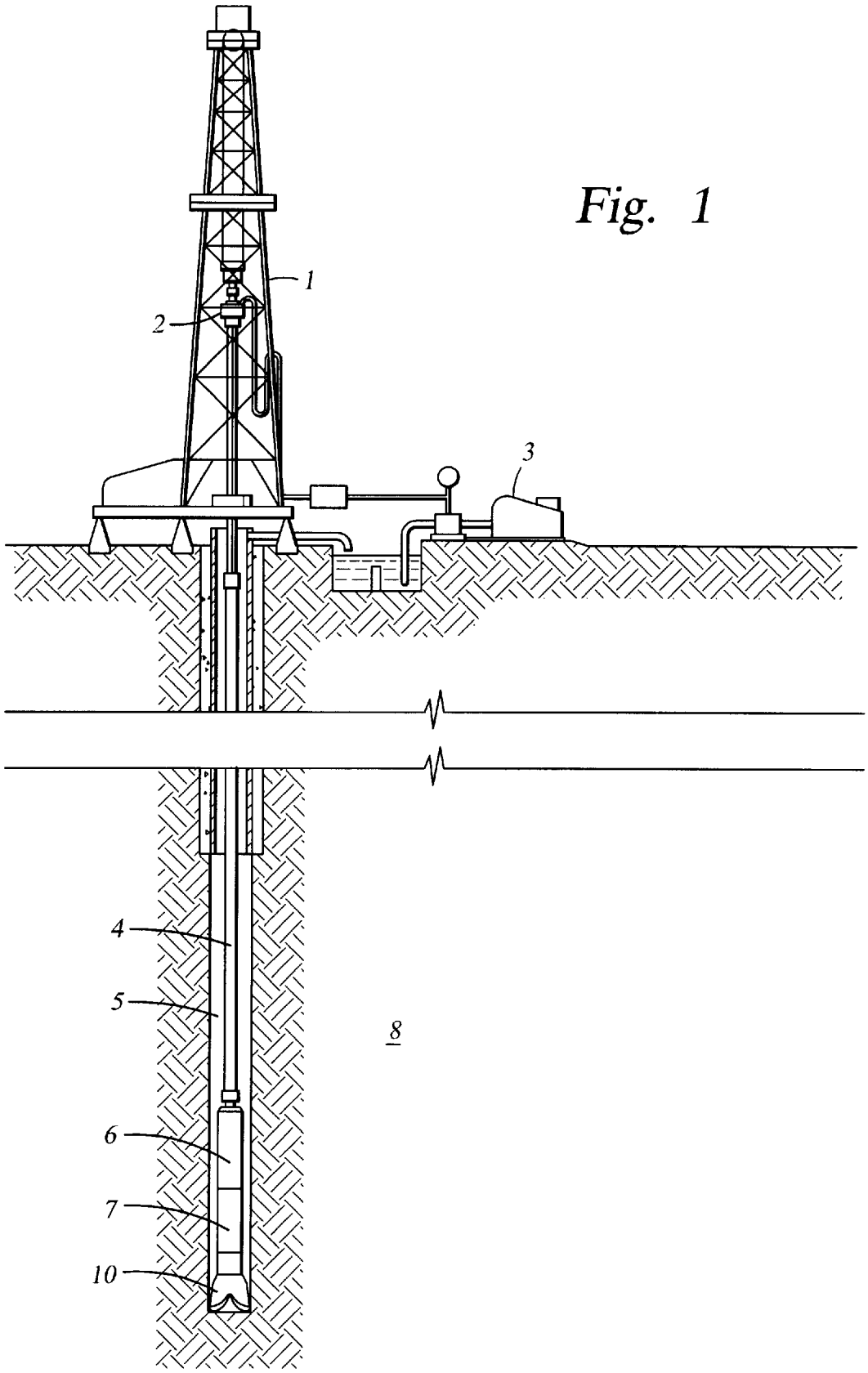
FIG. 1 shows a drill string in a wellbore as used to turn a drill bit.

FIG. 1 shows a drill bit 10 which may be any one of a number of various embodiments of the invention as it is used to drill a wellbore 5 through earth formations 8. The drill bit 10 is coupled to the lower end of a drill string 4, which typically includes segments of drill pipe (not shown separately) threadedly coupled together. The drill bit 10 may be coupled to the drill string 4 directly or through various drilling tools such as a drill collar 6, and rotary steerable drilling system 7. It should be understood that the drill string configuration shown in FIG. 1 is only one example of a drilling tool assembly which may be used with a drill bit according to the invention, and therefore, the drill string configuration of FIG. 1 is not intended to limit the invention. The drill string 4 may be rotated by a rotary table (not shown in FIG. 1) or a top drive system 2 which is itself hoisted and lowered by a drilling rig 1. Drilling fluid ("drilling mud") is circulated through the drill string 4 by mud pumps 3 of any type known in the art. The drilling mud is pumped through the interior of the drill string 4 where it is ultimately discharged through jets (not shown in FIG. 1) on the drill bit 10. After being discharged through the jets, the drilling mud returns to the earth's surface through an annular space between the wellbore 5 and the exterior of the drill string 4. As is known in the art, the number of, placement of and sizes of the jest (not shown in FIG. 1) are selected to provide a desired amount of fluid pressure drop in the drill string, among other factors.

Figure 2:
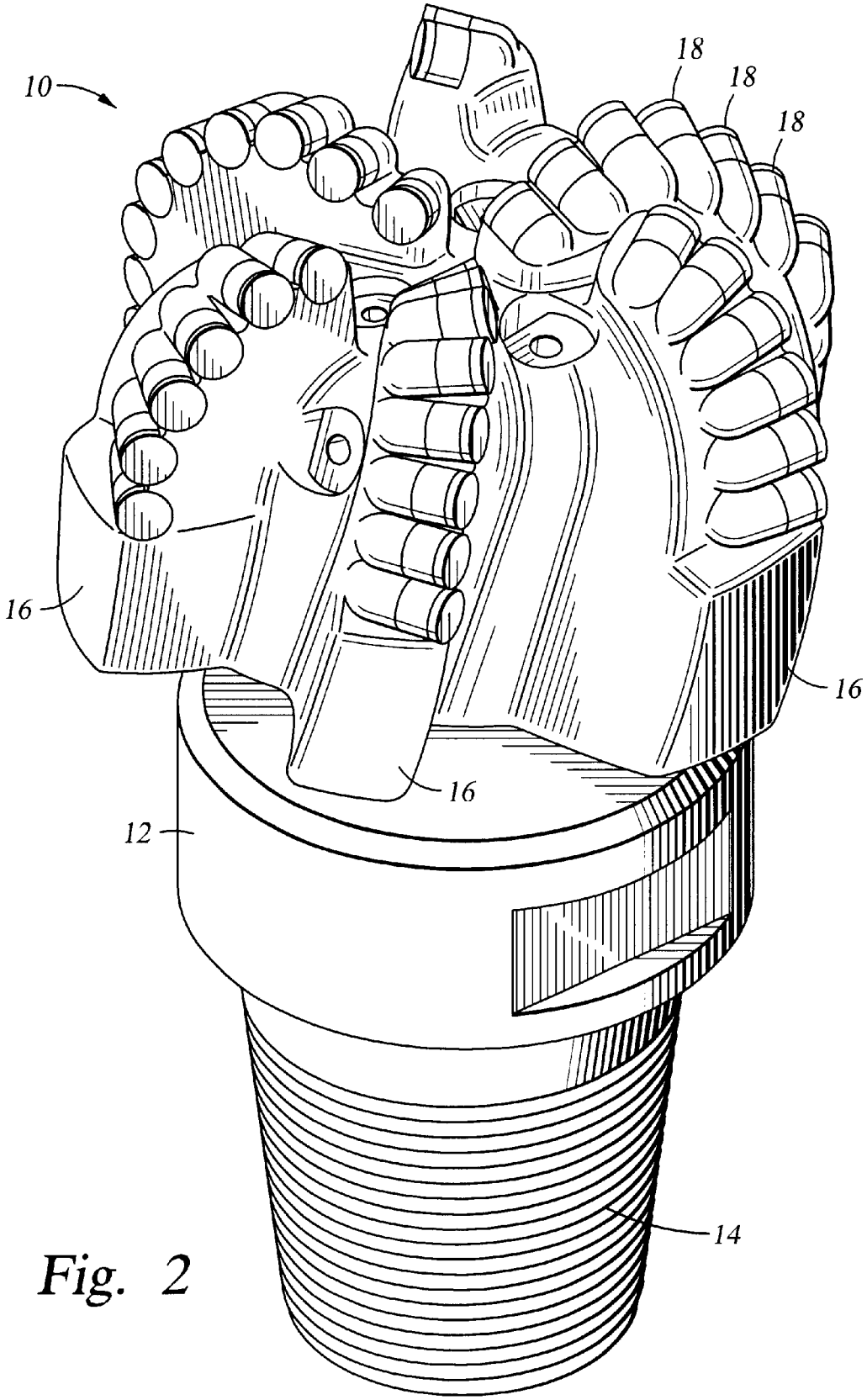
FIG. 2 shows an oblique view of one embodiment of a drill bit which can be made according to the invention.
Figure 3:
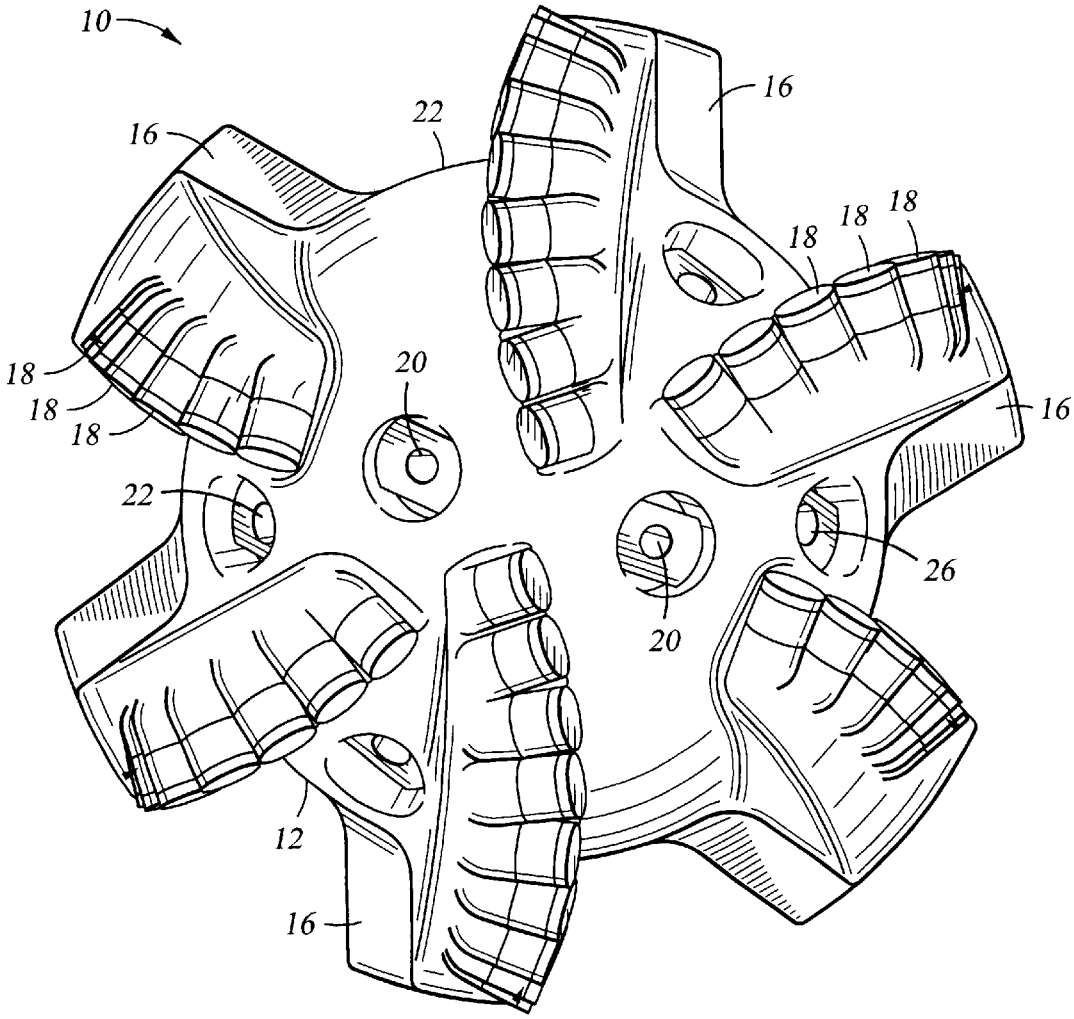
FIG. 3 shows an end view of the example bit in FIG. 2.

A typical drill bit which may include any one or more of a number of various embodiments of the invention is shown in oblique view in FIG. 2. The drill bit 10 includes a bit body 12 made from steel or matrix material. The bit body 12 typically has a coupling 14, usually a threaded pin or box, to attach it to the drill string (4 in FIG. 1). This particular bit body 12 includes a plurality of blades 16 onto which are affixed cutting elements 18, such as polycrystalline diamond compact ("PDC") inserts, for example. Referring to FIG. 3, the drill bit 10 includes jets 20 which, as previously explained, provide a path for discharging the drilling fluid from the interior of the drill string (4 in FIG. 1) into the wellbore (5 in FIG. 1). One or more of the ports (not shown separately in FIG. 3) for the jets 20 may alternatively be filed with a solid plug instead of a jet. This example drill bit 10 also includes one or more adjustable ports 22, some of which may include a solid plug therein, or a fixed orifice, depending on the total flow area (TFA) required for the particular drill bit and earth formations being drilled. As is known in the art, the flow area of each of the jets 20 and any orifices in the adjustable ports 22 are selected to provide the desired amount of TFA for the drill bit 10. In prior art drill bits, as explained in the Background section herein, changing the TFA includes changing any one of more of the jets 20 and/or plugs or orifices in any of the adjustable ports 22.

Although a bit according to the invention is shown in FIGS. 2 and 3 as being included in a PDC (fixed cutter) drill bit, it should be clearly understood that the invention is equally applicable to roller cone bits. Accordingly the type of bit is not intended to limit the scope of the invention. Irrespective of the type of bit, for purposes of defining the invention, the bit body can be thought of as having at least one cutting element operatively coupled to the bit body. In the case of PDC or similar fixed cutter bits, such as shown in FIGS. 2 and 3, the cutting element is affixed to the bit body. Roller cone bits have at least one cutting element in the form of a milled tooth or insert affixed to at least one roller cone, which is itself rotatably mounted to the bit body.

Generally speaking, a drill bit according to the invention includes at least one flow relief disposed in the bit to make an hydraulic connection between the interior of the bit body and the exterior of the bit body upon application of a selected drilling fluid flow characteristic to the interior of the drill bit. The selected fluid flow characteristic may include application of a selected differential pressure, or application of a selected fluid flow rate and/or total mud flow volume to the drill bit. The at least one flow relief is adapted to provide an increase in TFA when the at least one flow relief is actuated.

Figure 4:
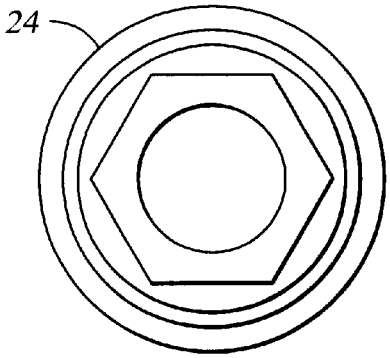
FIG. 4 shows one embodiment of a rupture disk which can be used in a bit according to the invention.

One embodiment of a flow relief can be better understood by referring to FIG. 4. In FIG. 4, the flow relief is a rupture disk 24. The rupture disk 24 may be adapted to fit in any one or more of the adjustable ports (22 in FIG. 3) or may be adapted to replace any one or more of the jets (20 in FIG. 3). Rupture disks such as may be used in some embodiments of the invention are a type of plug which is adapted to fail (open to flow permanently) at a selected differential pressure. One type of rupture disk is described, for example, in a brochure entitled, *Pressure Activation Device,* published by Fike Corporation, Blue Springs, Mo. 64105 (1999). In a drill bit according to this embodiment of the invention, the TFA of the bit (10 in FIG. 3) may increased by momentarily increasing the flow rate from the mud pumps (3 in FIG. 1) to provide a pressure drop across the bit which exceeds the rated burst or failure pressure of the rupture disk 24. When ruptured, the disk 24 provides an additional flow area through the bit, thereby increasing the TFA. The rated failure pressure of the rupture disk 24 can be selected to provide the increased TFA where, for example, a rotary steerable drilling system having a limitation on pressure drop is used, or where drilling progresses to a depth where it would be useful to increase the TFA of the bit to compensate for increases is fluid friction due to the length of the drill string (4 in FIG. 1).

In various embodiments of a drill bit according to the invention, any one or more of the adjustable ports (22 in FIG. 3) or any one or more of the jets (20 in FIG. 3) may be replaced with a rupture disk such as shown at 24 in FIG. 4.

Figure 5:
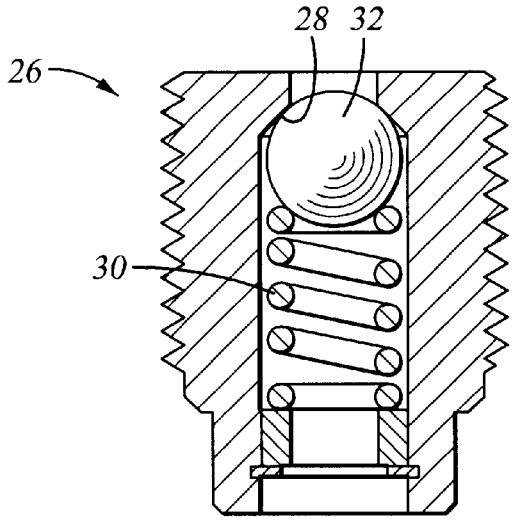
FIG. 5 shows an example of a pressure relief valve which can be used in a bit according to the invention.

Another embodiment of a flow relief is shown in FIG. 5. This embodiment of flow relief is a biased pressure relief valve 26. Bias may be provided, for example, by a spring 30 which forces a valve ball 32 against a valve seat 28 to stop flow until the force of the spring 30 is overcome by fluid pressure acting against the ball 32. The pressure relief valve 26 of FIG. 5 has the advantage, as compared to the rupture disk such as shown at 24 in FIG. 4, of being able to close again once the differential pressure across the pressure relief valve 26 drops below the rated differential pressure for the valve 26. As in the previous embodiment of FIG. 4, the pressure relief valve 26 of FIG. 5 may be used in any one or more of the adjustable ports 22 or any one or more of the jet ports on the bit body (12 in FIG. 2). When opened, the pressure relief valve 26 provides increased TFA to the bit.

Figure 6:
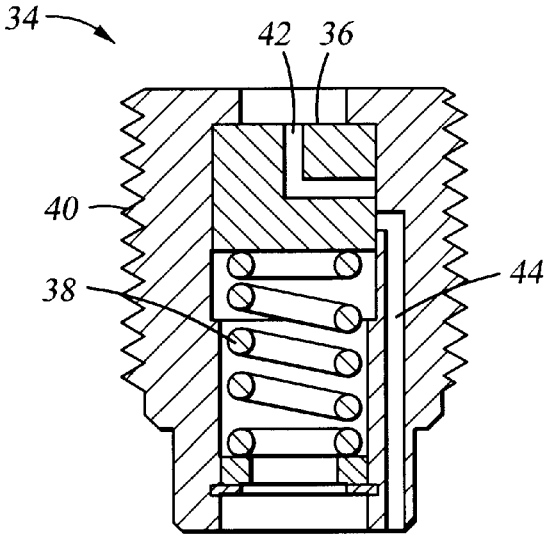
FIG. 6 shows another type of pressure relief valve which can be used in a bit according to the invention.

Another embodiment of a flow relief which can be used with a bit according to the invention is shown in FIG. 6. The flow relief 34 shown in FIG. 6 is a type of relief valve which may be similar in principle to "gas lift" valves used in some oil production systems. This type of relief valve is adapted to be opened upon application of a selected range of differential pressure, and is adapted to be closed at all other values of differential pressure. This adaptation is enabled by having a port 42 in a biased valve body 36 that is aligned with a corresponding port 44 in the valve housing 40 upon movement of the valve body 36 a selected distance. The selected distance is related to the biasing force from, for example, a spring 38, and the cross sectional area of the valve body 36. As in the previous embodiment, the flow relief 34 of FIG. 6 may be used in any one or more of the adjustable ports 22 or jet ports on the bit body (12 in FIG. 2). When opened, the pressure relief valve 34 provide increased TFA to the bit.

Figure 7:
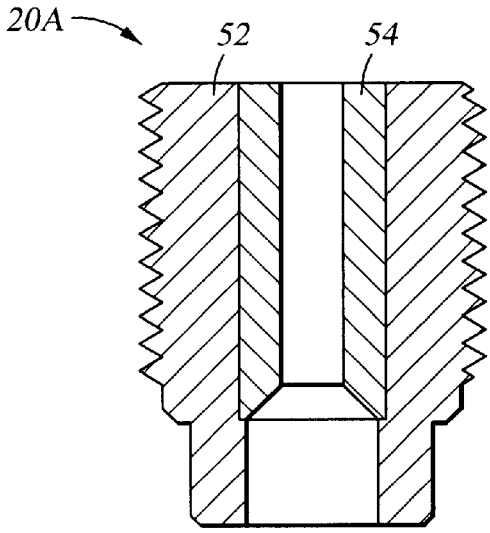
FIG. 7 shows another embodiment of a flow relief according to the invention.

Still another type of flow relief shown in FIG. 7 is adapted to provide an increase in TFA only by the flow of drilling mud through the bit for a selected time, and/or total flow volume. The flow relief 20A in FIG. 7 can be similar in construction to a conventional jet or nozzle, but includes an erodible material 54 disposed on an interior surface of the orifice of the jet body 52. The jet body 52 may be made from conventional jet body materials, such as tungsten carbide, while the erodible material 54 may be mild steel, or other substance that is adapted to wear away by the flow of mud through the relief 20A. When the erodible material 54 is worn away, the relief 20A presents a larger flow area to the bit than when the erodible material 54 is intact. A flow relief such as shown in FIG. 7 may be configured to provide the larger flow area of the jet body 52 after a selected volume of drilling mud has passed through the erodible material 54. The total flow volume, as is known in the art, is related to the rate at which the mud pumps (3 in FIG. 1) discharge drilling mud, and the uneroded orifice flow area of the flow relief 20A. As is the case for the other embodiments of flow relief according to the invention, the flow relief 20A of FIG. 7 may be inserted into any one or more of the adjustable ports (22 in FIG. 3) or may substitute any one or more of the jets (20 in FIG. 3).

Various embodiments of the invention provide a drill bit which can have the total flow area changed during drilling without the need to remove the drill bit from the wellbore.

While the invention has been described with respect to a limited number of embodiments, those skilled in the art will appreciate that other embodiments of the invention can be readily devised which do not depart from the spirit of the invention as disclosed herein. Accordingly, the invention shall be limited in scope only by the attached claims.

What is claimed is:

1. A drill bit, comprising:

a bit body having a plurality of ports therein arranged to provide a flow path between an interior of a drill string and the exterior of the bit body; and at least one flow relief disposed in one of the ports, the at least one flow relief adapted to change a total flow area of the drill bit upon application of a selected fluid flow condition to the drill bits, wherein the at least one flow relief comprises a biased pressure relief valve.

2. The drill bit as defined in claim 1 wherein the selected flow condition comprises a predetermined differential pressure across the drill bit.

3. The drill bit as defined in claim 1 wherein the selected flow condition comprises a predetermined total flow volume across the drill bit.

4. The drill bit as defined in claim 1 wherein the at least one flow relief comprises a rupture disk.

5. The drill bit as defined in claim 1 wherein the biased pressure relief valve is adapted to open above a selected differential pressure.

6. The drill bit as defined in claim 1 wherein the biased pressure relief valve is adapted to open within a selected range of differential pressure.

7. The drill bit as defined in claim 1 wherein the at least one flow relief comprises an orifice in an orifice body having an erodible material disposed therein, the erodible material adapted to be worn away after a selected volume of fluid has passed therethrough.

8. The drill bit as defined in claim 7 wherein the erodible material comprises mild steel.

9. A method for changing a total flow area of a drill bit, comprising:

pumping drilling fluid through the drill bit; and operating a flow relief disposed in the bit to change the total flow area of the bit, wherein the flow relief comprises a biased pressure relief valve.

10. The method as defined in claim 9 wherein operating the flow relief comprises increasing a differential pressure across the drill bit to at least a predetermined value.

11. The method as defined in claim 9 further comprising decreasing the total flow area of the bit by causing the differential pressure to drop below the predetermined value.

12. The method as defined in claim 9 wherein the operating the flow relief comprises maintaining a differential pressure across the drill bit within a predetermined range.

13. The method as defined in claim 9 wherein the operating the flow relief comprises causing a selected total volume of fluid to flow through the flow relief.

14. A drill bit, comprising:

a bit body having a plurality of ports therein arranged to provide a flow path between an interior of a drill string and the exterior of the bit body;

at least one cutting element operatively coupled to the bit body and at least one biased pressure relief valve disposed in one of the ports.

15. The drill bit as defined in claim 14 wherein the biased pressure relief valve is adapted to open above a selected differential pressure.

16. The drill bit as defined in claim 14 wherein the biased pressure relief valve is adapted to open within a selected range of differential pressure.

* * * * *